US007798878B1

(12) United States Patent
Lee

(10) Patent No.: US 7,798,878 B1
(45) Date of Patent: Sep. 21, 2010

(54) PERSONAL WINDSCREEN APPARATUS

(76) Inventor: Bobby Lee, 832 S. College St., Smithville, TN (US) 37166-2126

( * ) Notice: Subject to any disclaimer, the term of this patent is extended or adjusted under 35 U.S.C. 154(b) by 110 days.

(21) Appl. No.: 11/846,384

(22) Filed: Aug. 28, 2007

(51) Int. Cl.
*B63C 9/00* (2006.01)
*B63C 9/08* (2006.01)
*B63C 9/11* (2006.01)
*B63C 9/13* (2006.01)

(52) U.S. Cl. ..... 441/88; 441/106

(58) Field of Classification Search ..... 441/80–129; 2/6.3, 6.7, 15, 11, 424, 463
See application file for complete search history.

(56) References Cited

U.S. PATENT DOCUMENTS

| | | | | |
|---|---|---|---|---|
| 1,004,850 | A | | 3/1911 | Cogil |
| 1,191,773 | A | | 7/1916 | Dinkuhn |
| 2,564,952 | A | | 8/1951 | Blasius |
| 3,370,302 | A | | 2/1968 | Karlyn |
| 4,286,170 | A | | 8/1981 | Moti |
| 4,859,184 | A | | 8/1989 | Hazard |
| 4,951,660 | A | * | 8/1990 | Lubitzsch ..... 128/201.27 |
| 5,500,954 | A | | 3/1996 | Smith et al. |
| 5,549,495 | A | * | 8/1996 | Burnworth et al. ..... 441/108 |
| 5,692,933 | A | * | 12/1997 | Bradley et al. ..... 441/106 |
| 6,098,196 | A | | 8/2000 | Logan |
| 6,588,022 | B1 | | 7/2003 | Anders et al. |

FOREIGN PATENT DOCUMENTS

| | | | |
|---|---|---|---|
| GB | 743619 A | * | 1/1956 |
| GB | 1223587 A | * | 2/1971 |
| GB | 2162129 A | * | 1/1986 |
| JP | 2001233289 A | * | 8/2001 |
| WO | WO 9629241 A1 | * | 9/1996 |

* cited by examiner

*Primary Examiner*—Ajay Vasudeva
(74) *Attorney, Agent, or Firm*—Waddey & Patterson P.C.; Mark J. Patterson

(57) ABSTRACT

A personal windscreen apparatus is mounted on a boater's body to protect a boater's face during boating. The apparatus has a windscreen secured to a flotation device. The flotation device is secured to a boater's body utilizing a series of straps.

10 Claims, 3 Drawing Sheets

PERSONAL WINDSCREEN APPARATUS

BACKGROUND OF THE INVENTION

The present invention relates generally to devices for protecting a person's face from wind, water, and debris while that person is riding in a moving watercraft. More particularly, the present invention relates to portable windscreens that protect a boater's face during water sport activities.

Boating is often a high-speed activity. Passengers on boats often ride on the water at speeds exceeding 25 MPH. Many smaller boats, however, are not equipped to shield a boater's face from wind, water spray, debris and other dangerous objects while the boat is moving. For instance, a boater's face is completely exposed to flying debris when a boater sits or stands on the boat. Furthermore, it is not uncommon for debris such as small fragments of wood or dirt to fly into the boat while riding on a body of water. This presents a significant hazard to the safety of any boater.

Many small boats have windshields permanently mounted near forward facing boat seats. However, because of the distance between the boater's face and the windshield, the windshield is ineffective, particularly at high speeds. While the prior art reveals different types of body-mounted face guards and shields, a boater often wears some type of personal flotation device (PFD) during the boating activity. However, prior art face guards and shields do not fit on or with conventional PFD's. Consequently, a boater would not be able to safely use a prior art body-mounted windscreen in the boating environment.

What is needed, then, is a device that protects a boater's face while permitting the boater to wear the proper water safety equipment.

BRIEF SUMMARY OF THE INVENTION

This invention is a personal windscreen apparatus. The apparatus combines a personal flotation device (PFD) with a windscreen. The personal flotation device is shaped to fit on the boater's body thereby protecting the boater's face while at the same time allowing the boater to wear the proper water safety equipment. The disclosed apparatus may also have a windscreen separation flotation piece that separates the boater's face from the windscreen. In this manner, the windscreen always maintains the proper distance from the boater's face.

Accordingly, one object of the present invention is to provide a device that protects a boater's face while at the same time allowing a boater to wear the proper water safety equipment.

Another object of the present invention is to provide a windscreen boating apparatus that maintains the windscreen a proper distance from a boater's face.

Still, yet another object of the present invention is to provide a device that utilizes straps to attach a windscreen to a flotation device.

Yet another object of the present invention is to provide an easy mechanism for securing a windscreen to a user's body.

DETAILED DESCRIPTION OF THE INVENTION

Figure 1:
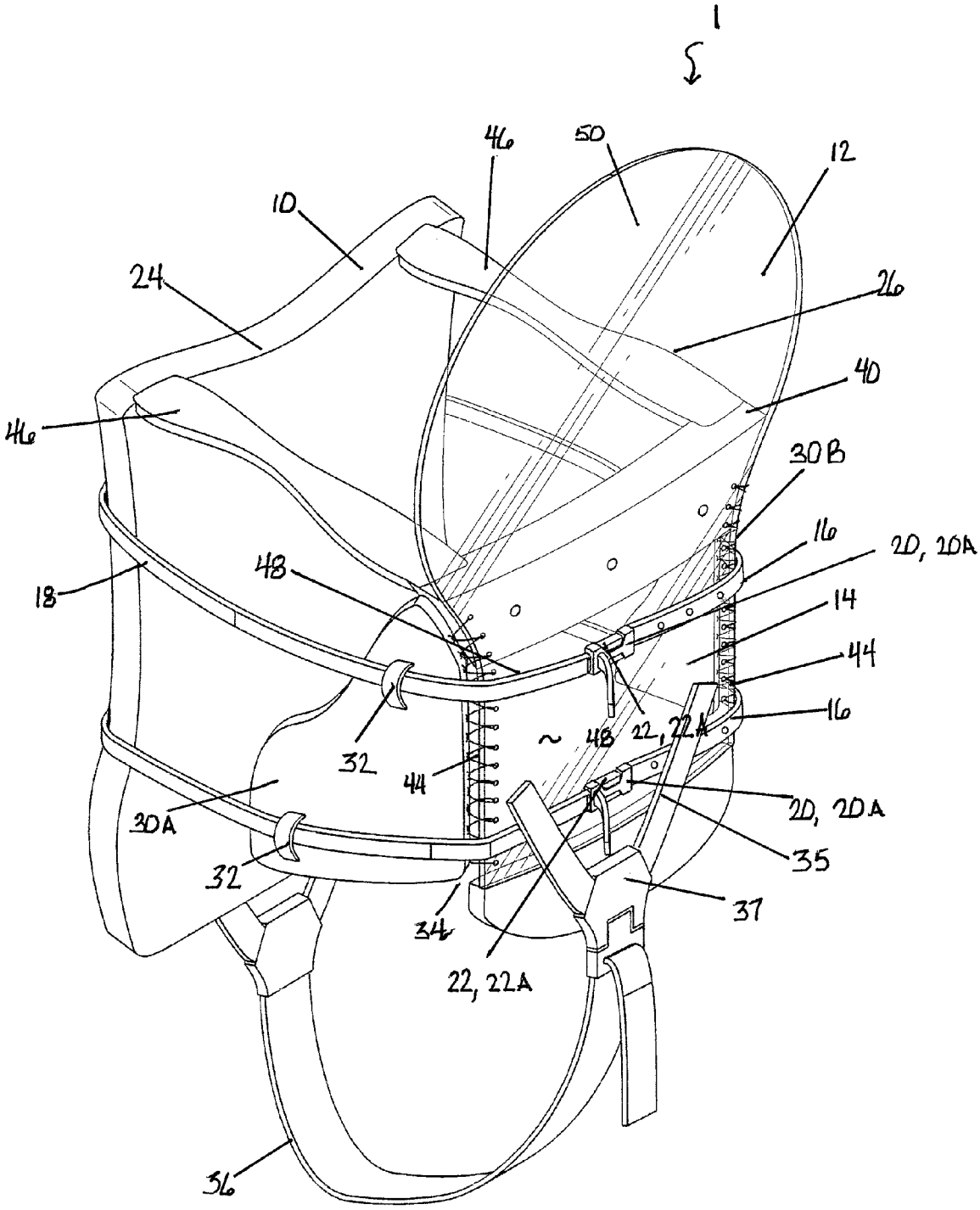
FIG. 1 is a perspective view of one embodiment of the personal windscreen apparatus of the present invention, shown in a closed configuration.
Figure 2:
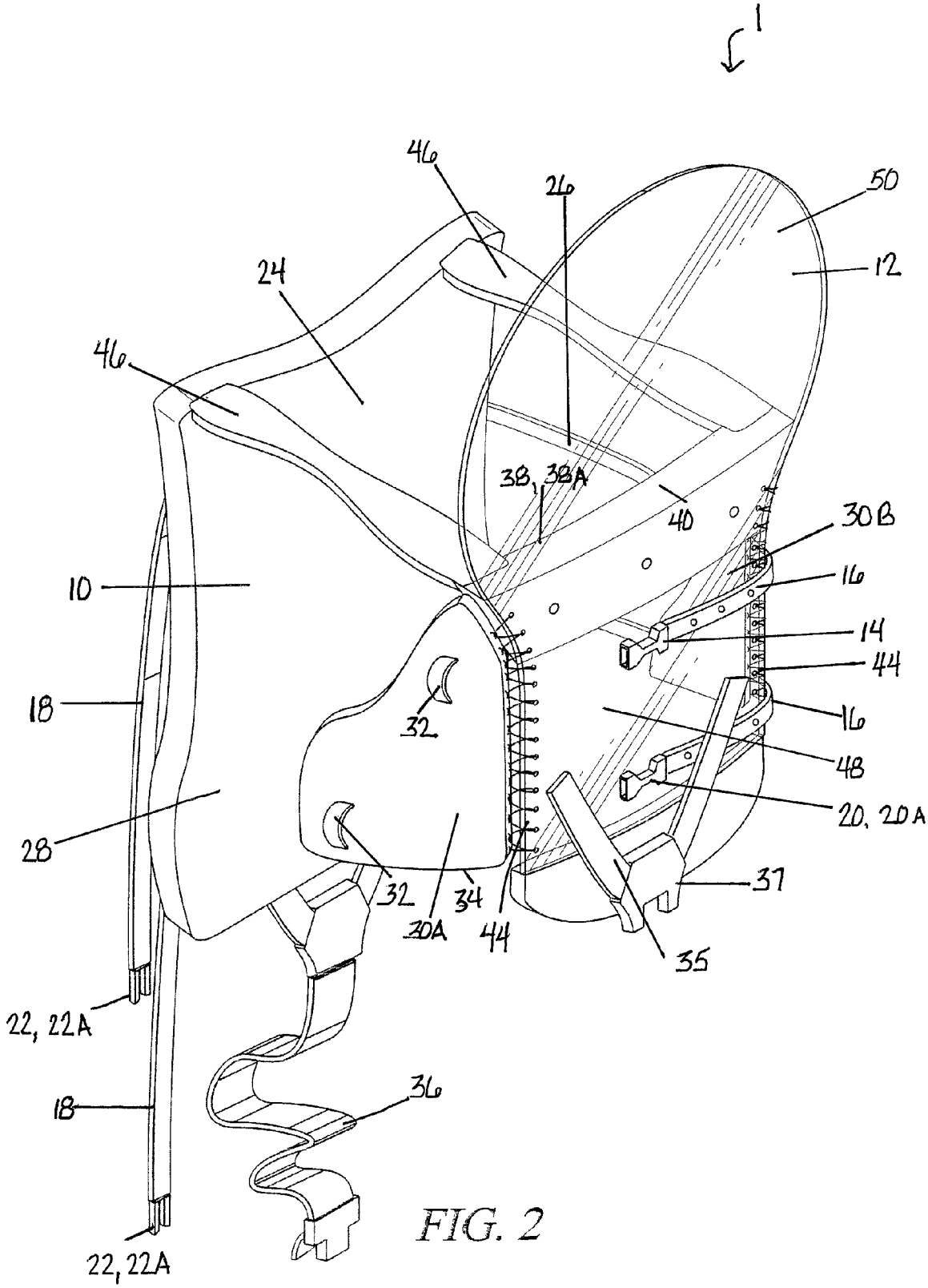
FIG. 2 is a perspective view of the personal windscreen apparatus of FIG. 1, shown in an open configuration.
Figure 3:
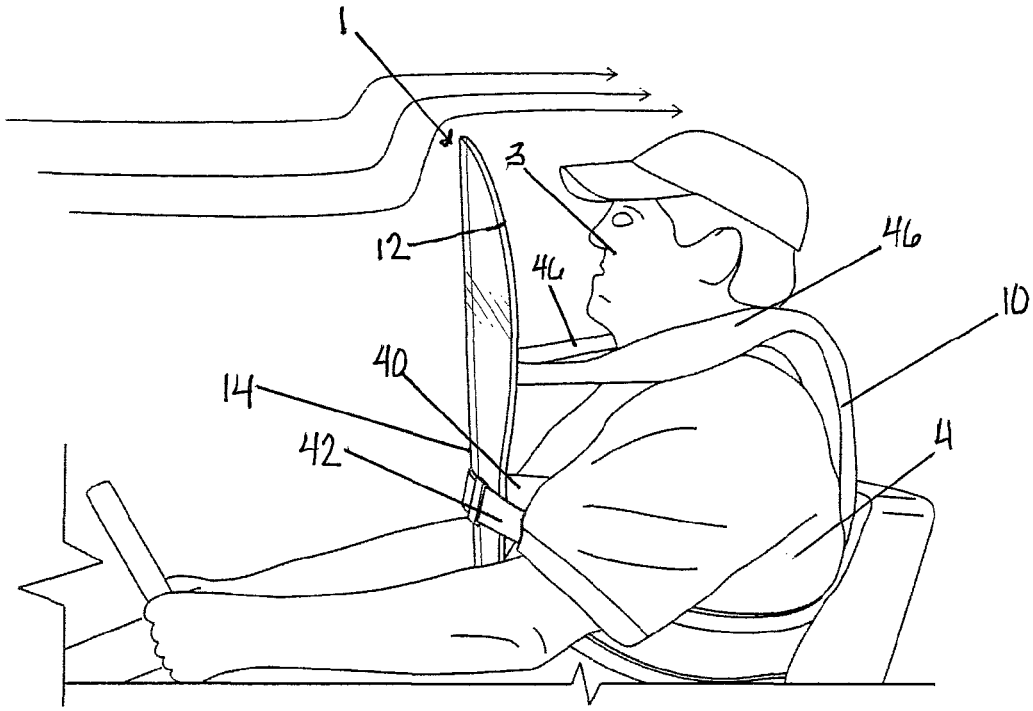
FIG. 3 is a side view of an embodiment of the personal windscreen apparatus being worn by a boater. This embodiment does not have one of the side portions so that the windscreen separation flotation piece can be seen resting against the boater's torso.
Figure 4:
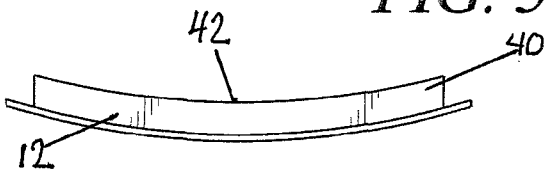
FIG. 4 is a top view of one embodiment of the windscreen.

Referring now to FIGS. 1-3, a personal windscreen apparatus 1 worn by a boater 2 is shown. The apparatus 1 is placed on the boater's torso 4 to protect the boater's face 3 and includes a personal flotation device 10 shaped to fit on a boater's torso 4. The flotation device 10 is thus preferably in the shape of a vest or a life jacket and can be made out of any material used to make life preservers and other buoyant water safety equipment.

A windscreen 12 is secured to a front portion 14 of the apparatus 1. By integrating the windscreen 12 into an apparatus 1 with a personal flotation device 10, the boater 2 can protect his face 3 from wind, spray, and debris and at the same time maintain proper water safety. The windscreen 12 is preferably made of a transparent or a semi-transparent material. In the preferred embodiment, the windscreen 12 is made of a tinted material suitable for absorbing sun radiation. In fact, the windscreen 12 can be made of any material so long as it has enough strength to handle the wind forces experienced on a moving boat.

As shown in FIGS. 1 and 2, the apparatus 1 is secured to the boater's torso utilizing a first and second set of straps 16, 18. Each of the straps 16 in the first set have a first engagement device 20 that engages the second set of straps 18. This engagement device 20 may simply be a tie-in buckle for engaging one of the second straps 18. However, in the preferred embodiment, each of the second straps 18 has a second engagement device 22. These engagement devices 20, 22 may be male/female buckles 20A, 22A. Each strap 16, 18 would have a complementary male/female buckle so that the devices 20A, 22A would interlock when engaged. In addition, the engagement devices 20 on the first set of straps 16 would ordinarily be attached to the front portion 14 of the apparatus. By attaching these engagement devices 20 to the front portion 14, the windscreen 12 on the front portion 14 can be secured to the flotation device 10.

In one embodiment of the invention (not shown), the front portion with the windscreen is opened so that a user may insert his torso for wearing the apparatus. This may be done by unsnapping the first set of straps 16 from the front portion. However, in the preferred embodiment, the flotation device 10 has a back portion 24. Each of the straps 16, 18 would be attached to the back portion 24 to define a closed side 26 and an open side 28. The open side 28 is shown in an open configuration in FIG. 2. The boater would insert his torso through the open side 28 to wear the apparatus 1 when the open side 28 is in the open configuration. As shown in FIG. 1, the open side 28 would be placed in a closed configuration by engaging the second straps 18 to the first engagement devices 20. To provide for a shapely and more buoyant flotation device 10, each side 26, 28 of the flotation device 10 could have side portions 30A, 30B. The second straps 18 would be inserted through the side portion 30A and engaged with the first engagement devices 20 to close the open side 28. This side portion 30A may define loops 32 for inserting the second straps 18 into the side portion 30A. By engaging the second straps 18 to the first engagement devices 20, the side portion 30A would fit snugly against the boater's torso.

As shown in FIGS. 1 and 2, another mechanism for securing the flotation device 10 to the boater's torso is the bottom strap 36. A strap 35 with an engagement device 37 is attached to the front portion 14. This engagement device 37 is preferably a clip that faces in a downward direction. The bottom strap 36 is attached to the back portion 24 to extend underneath a bottom opening 34 of the flotation device 10. When the bottom strap 36 is engaged to the engagement device 37, the apparatus 1 is stabilized between the boater's legs. This prevents the apparatus from twisting around the boater's torso during use. The bottom strap 36 preferably has a snap-on device that snaps on to the clip to engage the bottom strap 36 to the strap 35 on the front portion 14.

Figure 6:
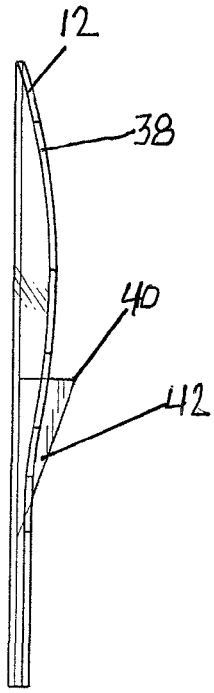
FIG. 6 is a side view of the embodiment of the windscreen shown in FIG. 4.

Referring again to FIGS. 1 and 2, in the preferred embodiment, the windscreen 12 should be maintained in a safe and comfortable distance from the boater's face. Thus, a windscreen separation flotation piece 40 is attached to an interior surface 38 of the front portion 14. As shown in FIG. 3, this separation flotation piece 40 is preferably shaped to rest against the boater's torso. Because the separation flotation piece 40 is buoyant, the piece 40 also helps maintain the boater's head above water. To maintain an appropriate distance from the boater's face 3, the separation flotation piece 40 preferably has an angled surface 42, as shown in FIGS. 3 and 6. This angled surface 42 separates the flotation device 10 from the windshield 12 when the device is worn by the boater 2.

In the preferred embodiment, the front portion 14 is integral with the windscreen 12. Thus, as is shown in FIGS. 1 and 2, the interior surface 38 of the front portion 14 is the interior surface 38A of the windscreen 12. Consequently, in the preferred embodiment the flotation piece 40 is attached to the interior surface 38A of the windscreen 12. Shoulder straps 46 can then be attached to the windscreen separation flotation piece 40. The shoulder straps 46 will rest over the boater's shoulders and attach to the separation flotation piece 40 resting against the boater's torso. This secures the apparatus 1 to the upper torso of the boater.

Figure 5:
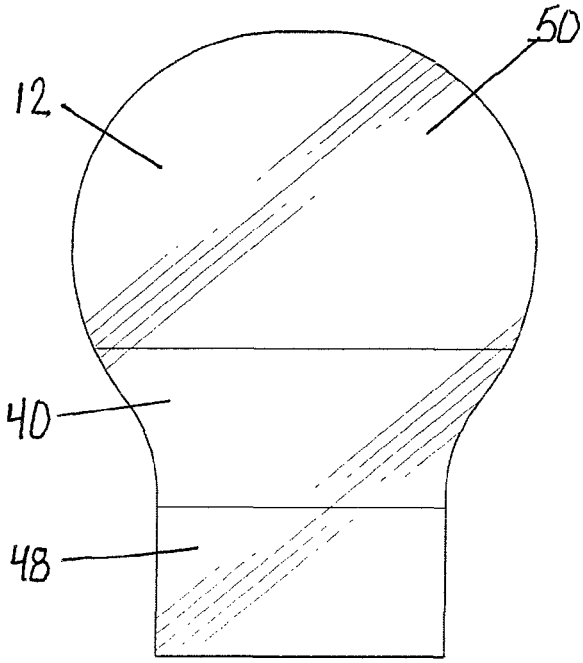
FIG. 5 is a front view of the embodiment of the windscreen shown in FIG. 4.

As is shown in FIGS. 1, 2 and 5, in the preferred embodiment the windscreen has an engagement portion 48 for engaging the flotation device 10 and a face shield portion 50 to protect the boater's face. To connect the engagement portion 48 to the flotation device 10, the engagement portion 48 may be laced with a lacing material 44 to the side portions 30 of the flotation device 10. This lacing material 44 should be strong enough to handle the forces placed on the windshield 12 by a boater. The face shield portion 50 should be of a sufficient height to go over the average boater's face. This portion 50 should also be shaped to redirect air around a boater's face. Normally, the face shield portion 50 will have a round shape that curves inward toward the boater, as shown in FIGS. 5 and 6. By utilizing a windscreen 12 of an adequate height and shape, air will be redirected around the boater 1, as shown in FIG. 3.

Thus, although there have been described particular embodiments of the present invention of a new and useful Personal Windscreen Apparatus, it is not intended that such references be construed as limitations upon the scope of this invention except as set forth in the following claims.

What is claimed is:

1. A personal windscreen apparatus for use in recreational or professional boating, comprising:

a personal flotation device shaped to fit on a boater's body;

a transparent or semi-transparent windscreen secured to the flotation device;

a front portion having an interior surface;

a windscreen separation flotation piece sized for separating the windscreen from a boater's face, the windscreen separation flotation piece being attached to the interior surface of the front portion;

wherein the windscreen separation flotation piece comprises an angled surface for resting against a boater's torso; and a lacing material woven between the windscreen and the flotation device.

2. A personal windscreen apparatus for protecting a boater's face during boating activities, comprising:

a flotation vest having a front portion, the front portion having an interior surface;

a substantially transparent windscreen attached to the front portion of the flotation vest;

a windscreen separation piece positioned on the interior surface so that the separation piece will rest against a torso of a boater wearing the apparatus, thereby separating the windscreen from the boater's face; and wherein the windscreen is laced to the vest with laces passing through the windscreen and the flotation vest.

3. The personal windscreen apparatus of the claim 2, wherein the windscreen separation piece comprises an angled surface.

4. The personal windscreen apparatus of claim 2, wherein the vest comprises a life jacket.

5. The personal windscreen apparatus of claim 2, wherein the vest comprises shoulder straps attached to the windscreen separation piece for attaching the windscreen to the vest.

6. The personal windscreen apparatus of claim 2, wherein the windscreen further comprises an engagement portion for engaging the vest and a face shield portion for protecting the user's face.

7. The personal windscreen of the claim 6, wherein the face shield portion is shaped to redirect air around a user's face.

8. The personal windscreen apparatus of claim 2, further comprising:

the vest having a back portion and left and right sides; and a first strap attached to both the back portion and the front portion to enclose one of the sides.

9. The personal windscreen apparatus of claim 8, further comprising:

the first strap having a first male or female buckle member;

a second strap attached to the vest, the second strap having a second male or female buckle member complementary to the first buckle member, the side opposite the side enclosed by the first strap being enclosed by the second strap when the second buckle member is engaged with the first buckle member.

10. The personal windscreen apparatus of claim 2, wherein the windscreen comprises a tinted material suitable for absorbing sun radiation.

* * * * *